US008960055B2

(12) United States Patent
Lin

(10) Patent No.: US 8,960,055 B2
(45) **Date of Patent: *Feb. 24, 2015**

(54) METHOD FOR MARKING A SOCKET

(71) Applicant: Pard Hardware Industrial Co., Ltd., Taichung (TW)

(72) Inventor: Da-Sen Lin, Taichung (TW)

(73) Assignee: Pard Hardware Industrial Co., Ltd., Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/902,800

(22) Filed: May 25, 2013

(65) Prior Publication Data

US 2013/0256142 A1 Oct. 3, 2013

Related U.S. Application Data

(62) Division of application No. 13/211,297, filed on Aug. 16, 2011, now abandoned.

(51) Int. Cl.

| | |
|---|---|
| ***B25B 13/06*** | (2006.01) |
| ***B25B 13/02*** | (2006.01) |
| ***B41M 5/00*** | (2006.01) |
| ***C25D 5/02*** | (2006.01) |

(52) U.S. Cl.

CPC ..... *B41M 5/00* (2013.01); *B25B 13/06* (2013.01); *C25D 5/022* (2013.01)

USPC ..... 81/121.1; 81/119

(58) Field of Classification Search

USPC ..... 81/121.1, 119

See application file for complete search history.

(56) References Cited

U.S. PATENT DOCUMENTS

| | | | | |
|---|---|---|---|---|
| 4,982,627 | A * | 1/1991 | Johnson | 81/121.1 |
| 7,448,121 | B1 * | 11/2008 | Hung | 29/56.5 |
| 8,020,274 | B2 * | 9/2011 | Lin | 29/458 |
| 2005/0193874 | A1 * | 9/2005 | Shih | 81/121.1 |
| 2006/0090612 | A1 * | 5/2006 | Peng | 81/121.1 |
| 2007/0131065 | A1 * | 6/2007 | Shih | 81/121.1 |
| 2009/0288522 | A1 * | 11/2009 | Tseng | 81/121.1 |
| 2010/0095813 | A1 * | 4/2010 | Hsieh | 81/468 |
| 2013/0042726 | A1 * | 2/2013 | Lin | 81/124.6 |

* cited by examiner

*Primary Examiner* — Monica Carter
*Assistant Examiner* — Danny Hong

(57) ABSTRACT

Disclosed is a method for marking a socket. The method includes the steps of providing a socket, making at least one indented mark in the surface of the socket, executing a heat treatment on the surface of the socket, providing at least one colored layer in the indented mark, providing an electroplated layer on the surface of the socket except the colored layer, removing a portion of the electroplated layer from the surface of the socket to form an exposed portion of the surface of the socket, and providing a black-dyed layer on the exposed portion of the surface of the socket. The heat treatment can be executed after the colored layer is provided.

10 Claims, 9 Drawing Sheets

FIG 1

METHOD FOR MARKING A SOCKET

CROSS-REFERENCE

The present application is a divisional application of U.S. patent application Ser. No. 13/211,297, and claims the domestic filing date of Aug. 16, 2011 filed by the applicant thereof.

FIELD OF INVENTION

The present invention relates to a socket wrench and, more particularly, to a method for marking a socket of a socket wrench so that the socket bears a clear, durable and aesthetic mark.

BACKGROUND OF INVENTION

To drive a fastener such as a threaded bolt and a nut, an open-ended wrench, a box-ended wrench, a monkey wrench or a socket wrench may be used. A socket wrench kit includes a handle and a set of sockets of various sizes. In operation, the handle is connected to a selected one of the sockets for driving a fastener of a certain size. Thus, a socket wrench kit can be used to drive fasteners of various sizes. A socket wrench kit is lighter and less expensive than a set of open-ended wrenches or box-ended wrenches. The handle of a socket wrench kit often includes a selective one-way driving mechanism. Therefore, a socket wrench kit is more convenient than a monkey wrench.

It is important to mark the sockets of a socket wrench kit to indicate the sizes of the sockets. There has been an attempt to provide plastic collars of different colors on sockets of different sizes. The plastic collars could easily be blurred, damaged or detached from the sockets so that the sockets would be poorly marked or not marked at all.

Alternatively, indented marks may be made in the sockets by pressing. It however requires an expensive machine to execute the pressing. Moreover, the indented marks are unclear on the sockets. This problem will be even worse when the indented marks are filled with dirt and grease after some time of use.

A socket is generally coated after the pressing. The electroplated layer is useful in protecting the socket from rust. The electroplated layer is provided on the socket in and outside the indented mark. That is, the color of the socket in the indented mark is identical to the color of the socket outside the indented mark. The electroplated layer makes the indented marks more unclear.

There has been another attempt to provide manganese phosphate on a socket after the pressing. The manganese phosphate is useful in protecting the socket from rust. The manganese phosphate however makes the socket look black and blur the indented mark.

More methods for providing tools with identification systems can be found in Taiwanese Patent Publication No. 555626 and Taiwanese Patent Application Publication No. 200840683. However, only the colors of silver and black can be provided on the tools, and this is not satisfactory regarding the diversity of trademarks.

Therefore, the present invention is intended to obviate or at least alleviate the problems encountered in prior art.

SUMMARY OF INVENTION

It is the primary objective of the present invention to provide a method for marking a socket.

To achieve the foregoing objective, the method includes the steps of providing a socket, making at least one indented mark in the surface of the socket, executing a heat treatment on the surface of the socket, providing at least one colored layer in the indented mark, providing an electroplated layer on the surface of the socket except the colored layer, removing a portion of the electroplated layer from the surface of the socket to form an exposed portion of the surface of the socket, and providing a black-dyed layer on the exposed portion of the surface of the socket.

In the method, the heat treatment can be executed after the colored layer is provided.

Other objectives, advantages and features of the present invention will be apparent from the following description referring to the attached drawings.

BRIEF DESCRIPTION OF DRAWINGS

The present invention will be described via detailed illustration of two embodiments referring to the drawings wherein.

DETAILED DESCRIPTION OF EMBODIMENTS

Figure 2:
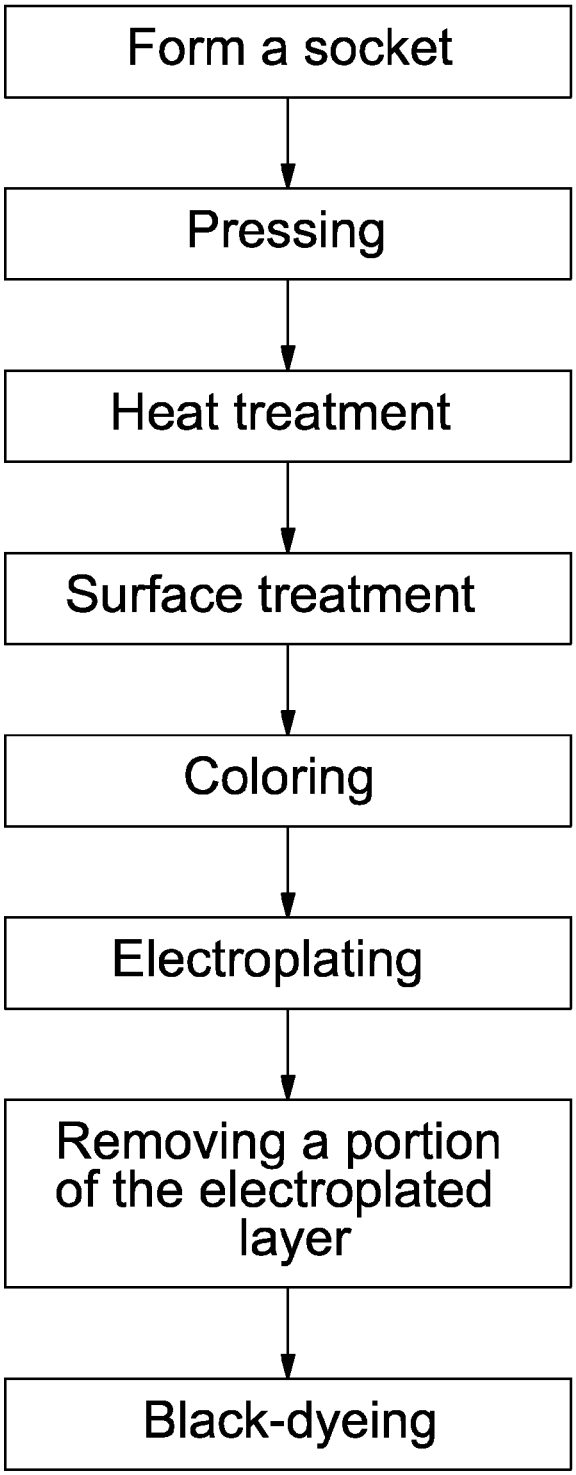
FIG. 2 is a flow chart of the method in accordance with the first embodiment of the present invention.
Figure 3:
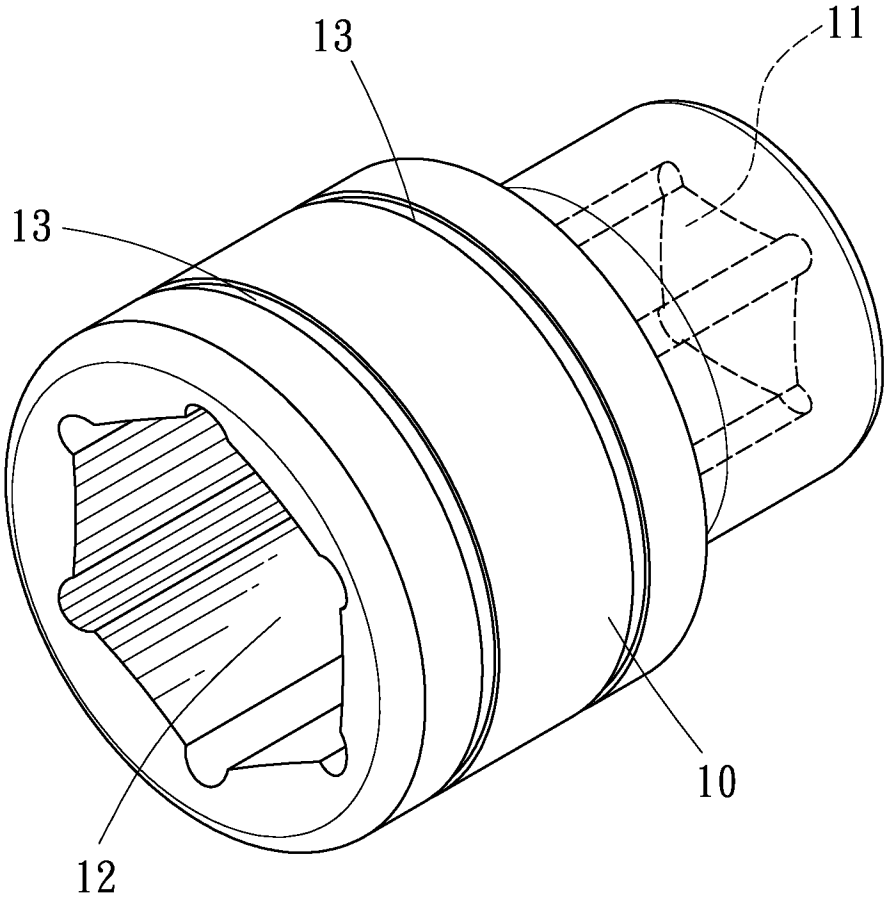
FIG. 3 is a perspective view of the socket before it is marked by the method shown in FIG. 2.

Referring to FIG. 2, there is shown a method for marking a socket 10 shown in FIG. 3 in accordance with a first embodiment of the present invention. Referring to FIGS. 2 and 3, the socket 10 is made of metal by casting and/or lathing for example. The socket 10 includes two sections 11 and 12. The first section 11 of the socket 10 includes a substantially square cavity axially defined therein for receiving a square tongue of a handle of a wrench. The second section 12 of the socket 10 includes a substantially hexagonal cavity axially defined therein for receiving a nut or a head of a screw. The second section 12 of the socket 10 preferably includes two annular grooves 13 defined in the surface (or the "external side") thereof.

Figure 4:
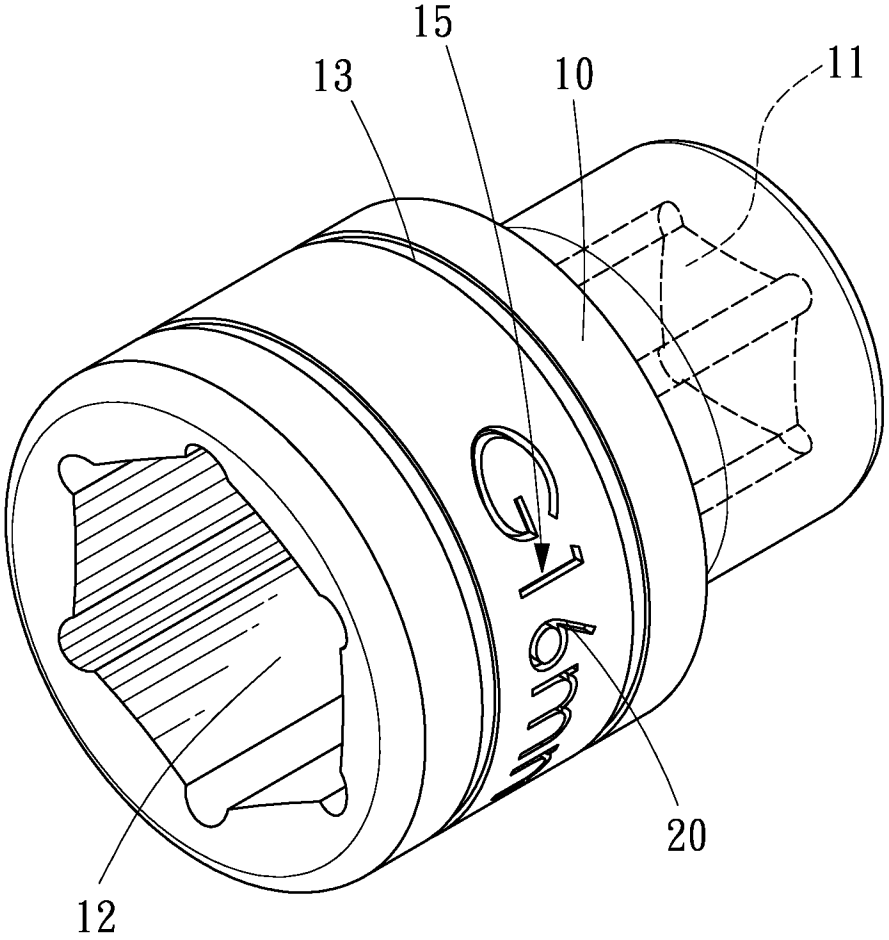
FIG. 4 is a perspective view of the socket with an indented mark made therein.

Referring to FIGS. 2 and 4, at least one indented mark 15 is made in the surface of the socket 10 by pressing, engraving or molding for example. The indented mark 15 is preferably made in the surface of the second section 12 of the socket 10. The indented mark 15 preferably includes a size, a trademark and/or a manufacturer's name.

Then, a heat treatment is conducted on the socket 10 to increase the hardness. Thus, a portion of the socket 10 near the indented mark 15, in particular, is not vulnerable to wearing. Therefore, the depth of the indented mark 15 is retained.

Then, a surface treatment is conducted on the socket 10. The surface treatment may be sand-blasting or grinding for example. Thus, the socket 10 and the indented mark 15 are clear of deckle edges. Furthermore, the surface of the socket 10 in the indented mark 15 is made rough to facilitate attachment of inks or dyes thereto.

Figure 5:
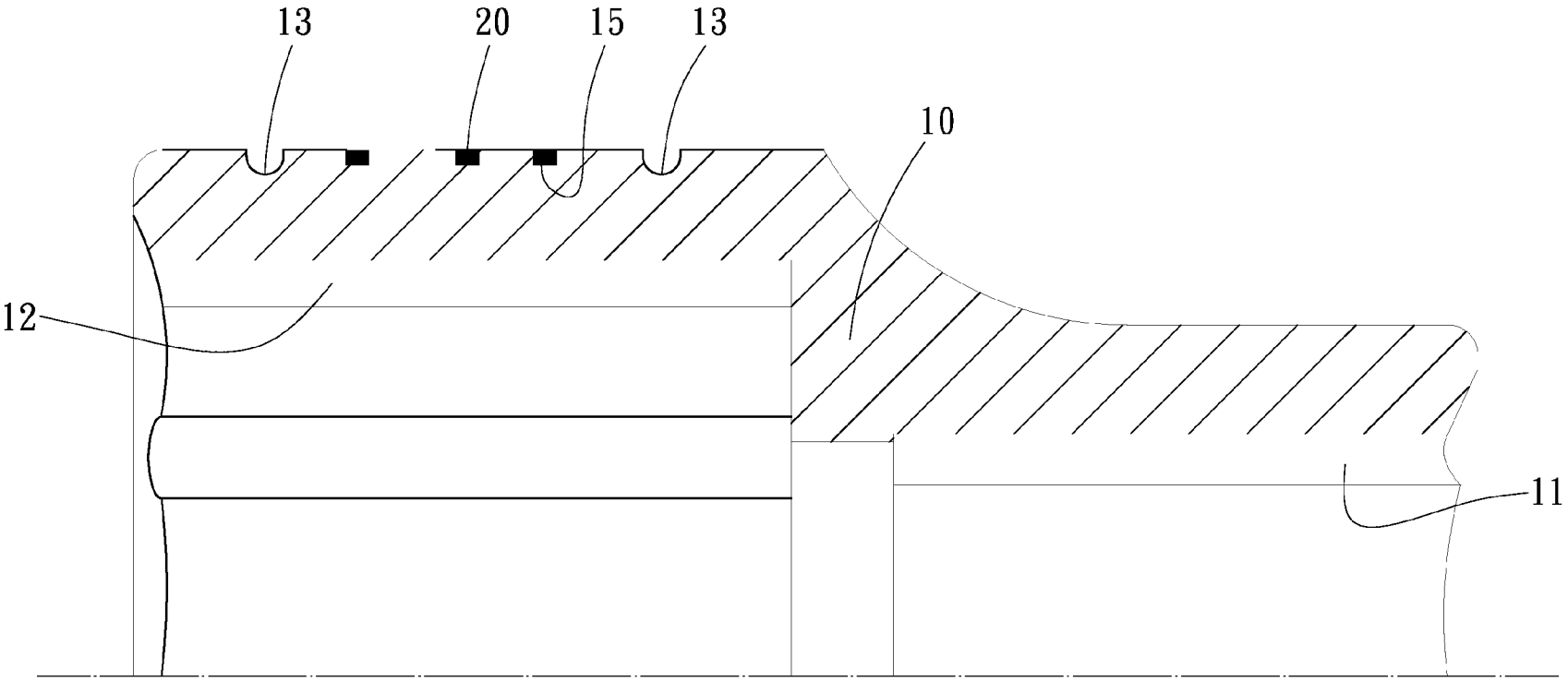
FIG. 5 is a cross-sectional view of the socket with a color filled in the indented mark shown in FIG. 4.

Referring to FIGS. 2 and 5, coloring is conducted on the socket 10 to form a colored layer 20 on the surface of the socket 10 in the indented mark 15. The colored layer 20 includes various colors. For example, the trademark may be in red while the size may be in green. The colored layer 20 is firmly attached to the surface of the socket 10 in the indented mark 15 since the surface of the socket 10 in the indented mark 15 is made rough before the coloring.

Figure 6:
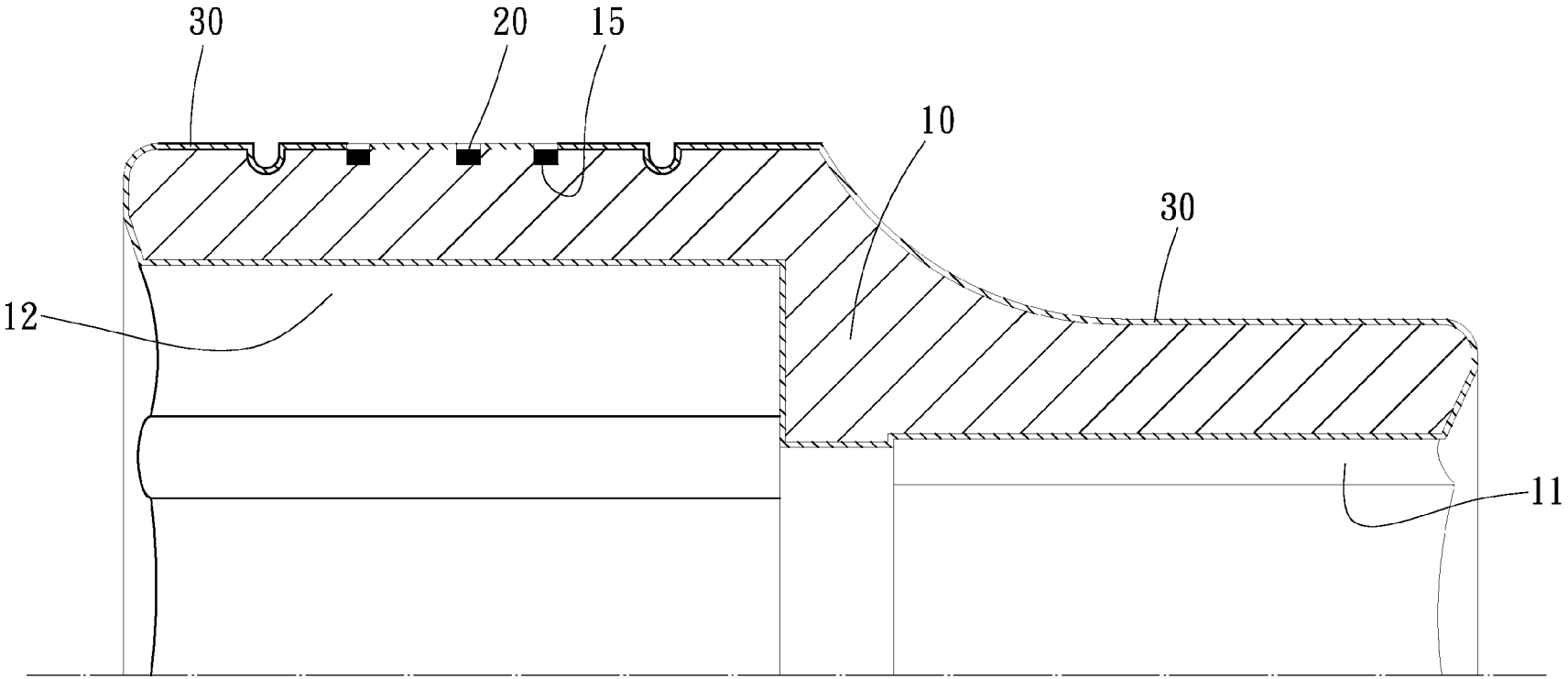
FIG. 6 is a cross-sectional view of the socket with an electroplated layer provided on the socket shown in FIG. 5.

Referring to FIGS. 2 and 6, electroplating is conducted on the socket 10 to form an electroplated layer 30 on the surface and an internal side of the socket 10 except the colored layer 20. The electroplated layer 30 is preferably a shining silver-like layer. The electroplated layer 30 cannot be provided on the colored layer 20 because the colored layer 20 is made of an isolating material.

Figure 7:
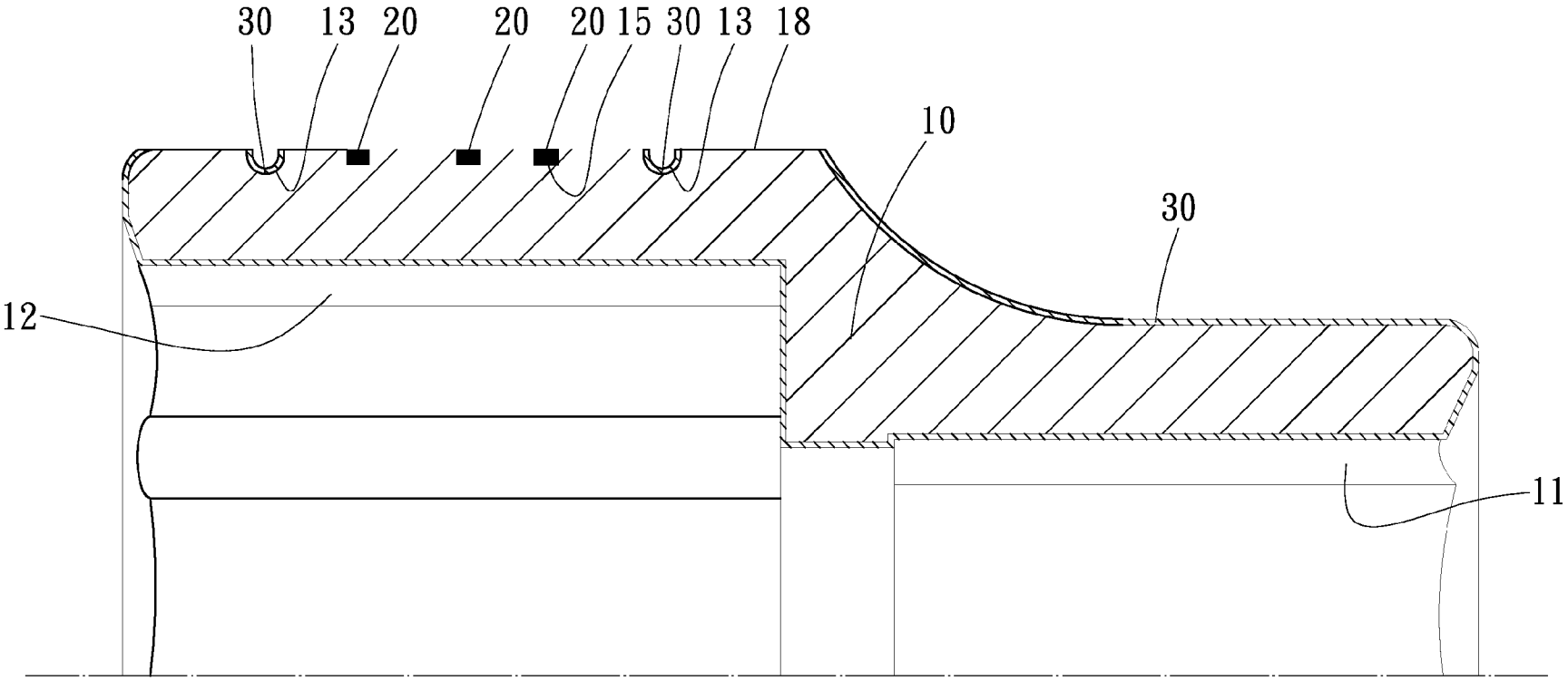
FIG. 7 is a cross-sectional view of the socket with some of the electroplated layer removed from the socket shown in FIG. 6.

Referring to FIGS. 2 and 7, by grinding for example, a portion of the electroplated layer 30 and colorant are removed from a portion of the surface of the second section 12 of the socket 10 located outside the indented mark 15 Thus, the surface of the socket 10 is made with an exposed portion 18. Because of the exposed portion 18, there is strong contrast between the colored layer 20 and the surface of the second section 12 of the socket 10.

Figure 8:
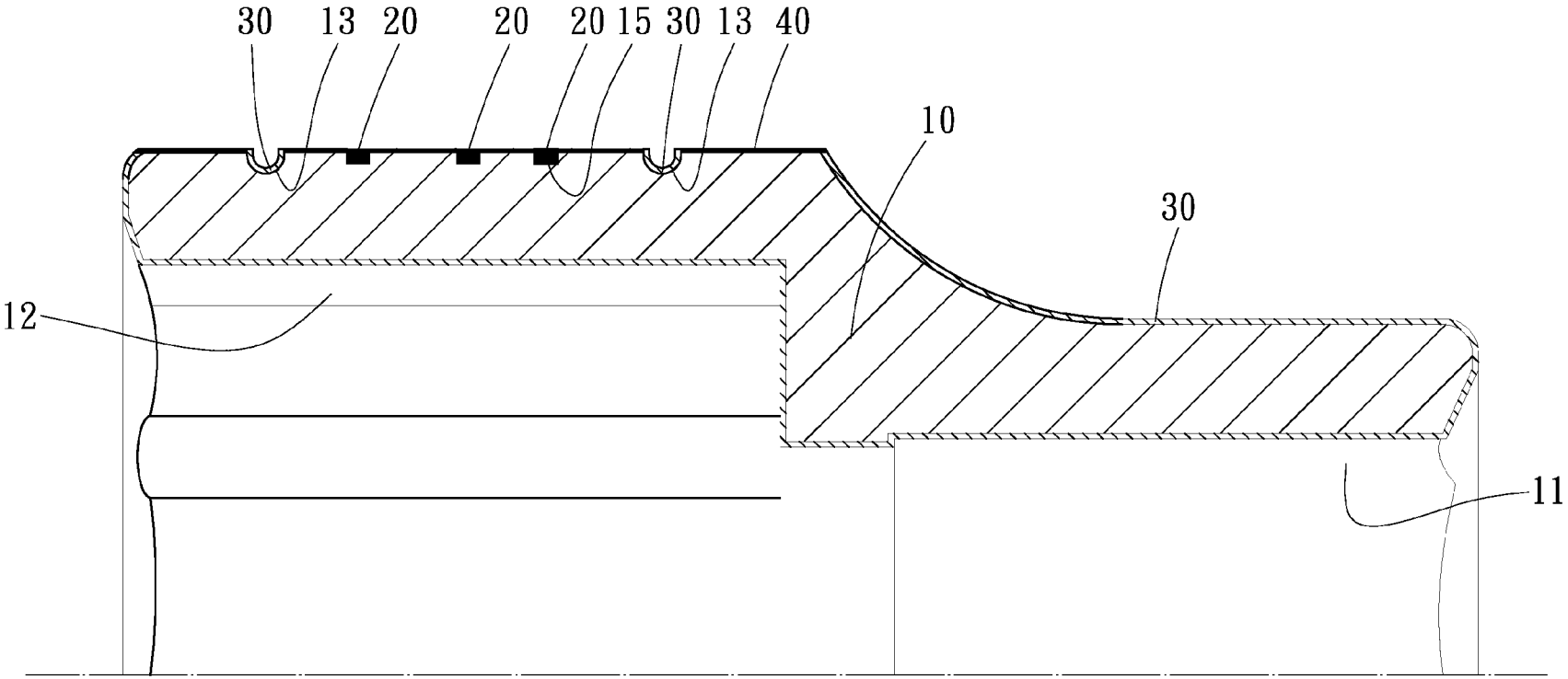
FIG. 8 is a cross-sectional view of the socket shown in FIG. 1.

Referring to FIGS. 2 and 8, a black-dyed layer 40 is provided on the exposed portion 18 of the surface of the second section 12 of the socket 10. The black-dyed layer 40 may be provided by black-dyeing or manganese phosphate.

The color of the black-dyed layer 40, the color of the electroplated layer 30 and the color of the colored layer 20 are different from one another. That is, the socket 10 is provided with at least three colors. Thus, the indented mark 15 is in strong contrast against the electroplated layer 30 and the black-dyed layer 40 so that the indented mark 15 is clear and the identification of the socket 10 is clear and easy.

Figure 1:
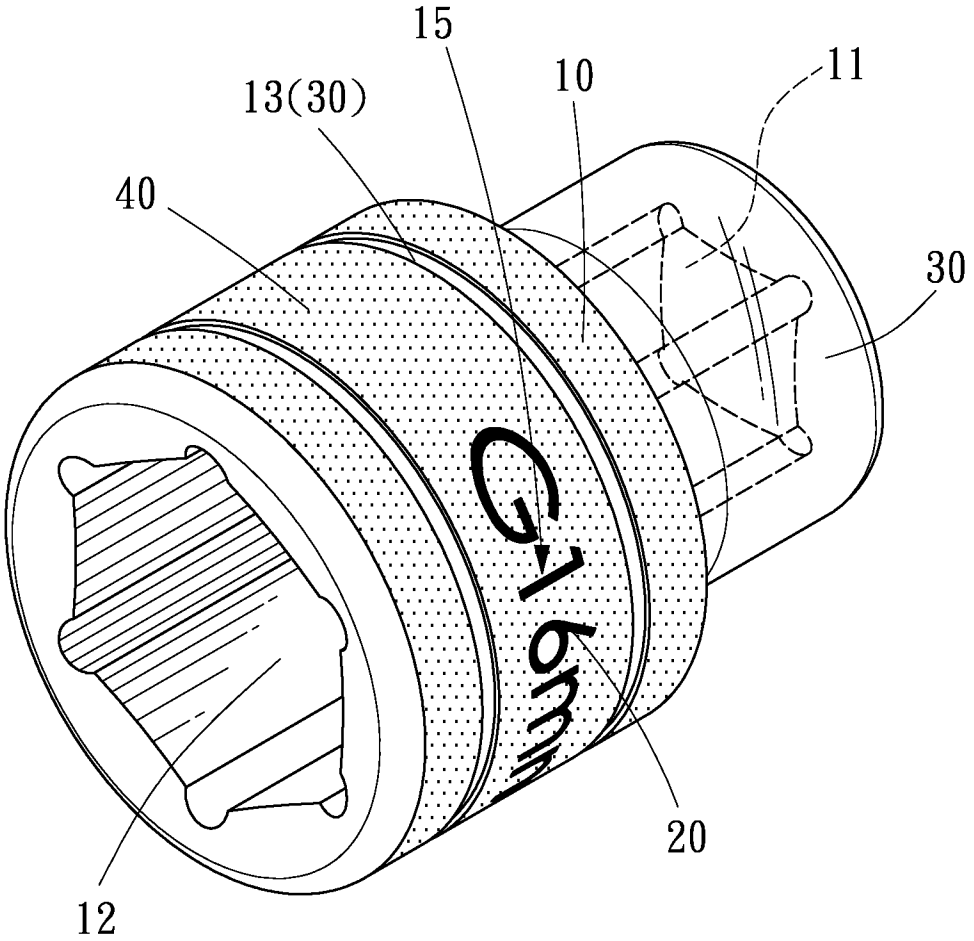
FIG. 1 is a perspective view of a socket marked by a method in accordance with the first embodiment of the present invention.

Referring to FIGS. 1 and 8, the socket 10 is made with the first and second sections 11 and 12. A nut or a head of a screw can be inserted in the hexagonal cavity defined in the first section 11 of the socket 10. A square tongue of a handle or a wrench can be inserted in the square cavity defined in the second section 12 of the socket 10. The socket 10 further includes the annular grooves 13 and the indented mark 15. The indented mark 15 may include a specification, a size and/or a trademark. A colored layer 20 is provided in the indented mark 15. The colored layer 20 includes various colors. For example, the trademark may be in red while the size may be in green. The socket 10 further includes the electroplated layer 30 and the black-dyed layer 40. The final product exhibits at least three colors to provide clear identification and an aesthetic look.

The socket 10 exhibits at least four advantages. Firstly, the attachment of the colored layer 20 to the socket 10 is firm because the colored layer 20 is attached to the surface of the socket 10 in the indented mark 15 that is made rough beforehand.

Secondly, the color of the black-dyed layer 40, the color of the electroplated layer 30 and the color of the colored layer 20 are different from one another. Thus, the colored layer 20 filled in the indented mark 15 is in strong contrast against the electroplated layer 30 and the black-dyed layer 40. Therefore, the colored layer 20 filled in the indented mark 15 looks clear amid the electroplated layer 30 and the black-dyed layer 40. Accordingly, the identification of the socket 10 is clear and easy.

Thirdly, the color of the black-dyed layer 40, the color of the electroplated layer 30 and the color of the colored layer 20 are different from one another. Therefore, the socket 10 is colorful and could be aesthetically pleasant.

Figure 9:
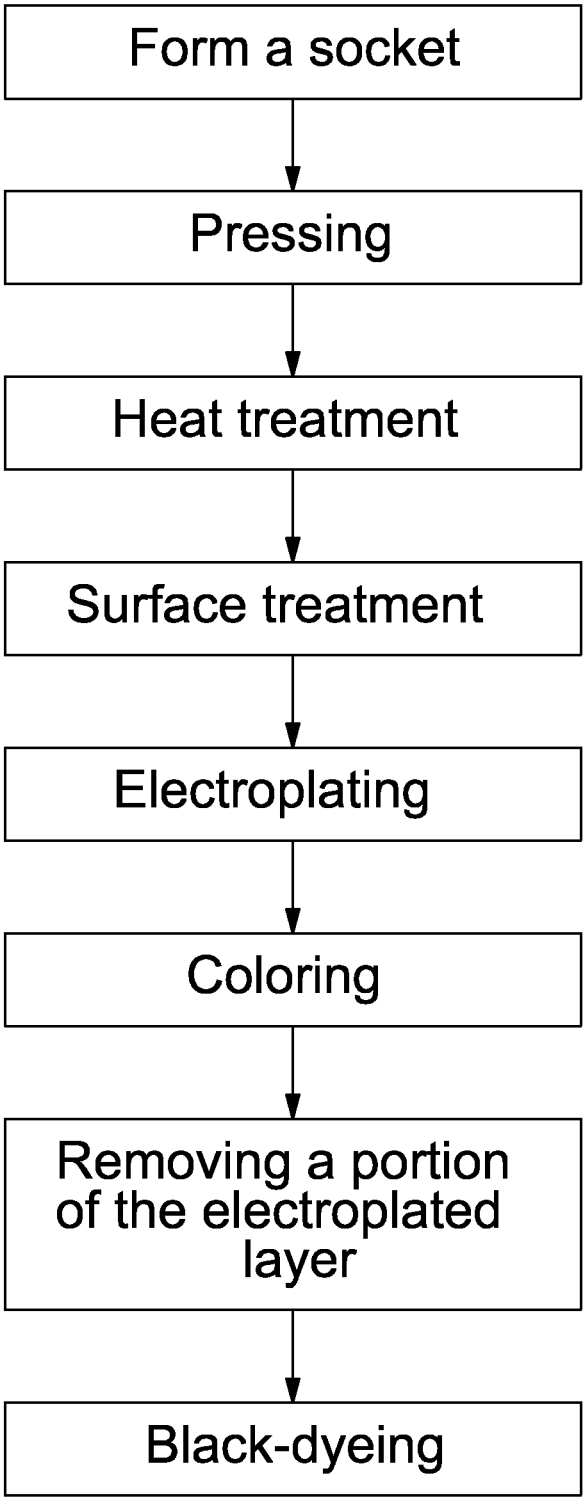
FIG. 9 is a flow chart of a method for making a socket in accordance with the second embodiment of the present invention.

Referring to FIG. 9, there is shown a method for marking a socket in accordance with a second embodiment of the present invention. Referring to FIGS. 9 and 3, a socket 10 is provided. The socket 10 is made of metal by casting and/or lathing for example. The socket 10 includes two sections 11 and 12. The first section 11 of the socket 10 includes a substantially square cavity axially defined therein for receiving a square tongue of a handle of a wrench. The second section 12 of the socket 10 includes a substantially hexagonal cavity axially defined therein for receiving a nut or a head of a screw. The second section 12 of the socket 10 preferably includes two annular grooves 13 defined in the surface (or the "external side") thereof.

Referring to FIGS. 9 and 4, at least one indented mark 15 is made in the surface of the socket 10 by pressing, engraving or molding for example. The indented mark 15 is preferably made in the surface of the second section 12 of the socket 10. The indented mark 15 preferably includes a size, a trademark and/or a manufacturer's name.

Then, a heat treatment is conducted on the socket 10 to increase the hardness. Thus, a portion of the socket 10 near the indented mark 15, in particular, is not vulnerable to wearing. Therefore, the depth of the indented mark 15 is retained.

Then, a surface treatment is conducted on the socket 10. The surface treatment may be sand-blasting or grinding for example. Thus, the socket 10 and the indented mark 15 are clear of deckle edges. Furthermore, the surface of the socket 10 in the indented mark 15 is made rough to facilitate attachment of inks or dyes thereto.

Referring to FIGS. 9 and 6, electroplating is conducted on the socket 10 to form an electroplated layer 30 on the surface and an internal side of the socket 10. The electroplated layer 30 is preferably a shining silver-like layer.

Referring to FIGS. 9 and 5, coloring is conducted on the socket 10 to form a colored layer 20 on the surface of the socket 10 in the indented mark 15. The colored layer 20 includes various colors. For example, the trademark may be in red while the size may be in green. The colored layer 20 is firmly attached to the surface of the socket 10 in the indented mark 15 since the surface of the socket 10 in the indented mark 15 is made rough before the coloring.

Referring to FIGS. 9 and 7, by grinding for example, a portion of the electroplated layer 30 and colorant are removed from a portion of the surface of the second section 12 of the socket 10 located outside the indented mark 15. Thus, the surface of the socket 10 is made with an exposed portion 18. Because of the exposed portion 18, there is strong contrast between the colored layer 20 and the surface of the second section 12 of the socket 10.

Referring to FIGS. 9 and 8, a black-dyed layer 40 is provided on the exposed portion 18 of the surface of the second section 12 of the socket 10. The black-dyed layer 40 may be provided by black-dyeing or manganese phosphate.

The color of the black-dyed layer 40, the color of the electroplated layer 30 and the color of the colored layer 20 are different from one another. That is, the socket 10 is provided with at least three colors. Thus, the indented mark 15 is in strong contrast against the electroplated layer 30 and the black-dyed layer 40 so that the indented mark 15 is clear and the identification of the socket 10 is clear and easy.

The second embodiment is like the first embodiment except the step of electroplating is executed before the step of coloring.

The present invention has been described via the detailed illustration of the embodiments. Those skilled in the art can derive variations from the embodiments without departing from the scope of the present invention. Therefore, the embodiments shall not limit the scope of the present invention defined in the claims.

The invention claimed is:

1. A method for marking a socket including the steps of:
providing a socket;
making at least one indented mark in the surface of the socket;
executing a heat treatment on the surface of the socket;
providing at least one colored layer in the indented mark;
providing an electroplated layer on the surface of the socket except the colored layer;
removing a portion of the electroplated layer from the surface of the socket, thus forming an exposed portion of the surface of the socket; and
providing a black-dyed layer on the exposed portion of the surface of the socket.

2. The method in accordance with claim 1, further including the step of executing a surface treatment on a portion of the surface of the socket in the indented mark between the step of executing the heat treatment and the step of providing the colored layer, thus roughing the portion of the surface of the socket in the indented mark to facilitate the attachment of the colored layer.

3. The method in accordance with claim 2, the surface treatment is sand-blasting.

4. The method in accordance with claim 2, the surface treatment is grinding.

5. The method in accordance with claim 1, wherein the colored layer is provided in various colors.

6. A method for marking a socket including the steps of:
providing a socket;
making at least one indented mark in the surface of the socket;
executing a heat treatment on the surface of the socket;
providing an electroplated layer on the surface of the socket except the colored layer;
providing at least one colored layer in the indented mark;
removing a portion of the electroplated layer from the surface of the socket, thus forming an exposed portion of the surface of the socket; and
providing a black-dyed layer on the exposed portion of the surface of the socket.

7. The method in accordance with claim 6, further including the step of executing a surface treatment on a portion of the surface of the socket in the indented mark between the step of executing the heat treatment and the step of providing the colored layer, thus roughing the portion of the surface of the socket in the indented mark to facilitate the attachment of the colored layer.

8. The method in accordance with claim 7, the surface treatment is sand-blasting.

9. The method in accordance with claim 7, the surface treatment is grinding.

10. The method in accordance with claim 6, wherein the colored layer is provided in various colors.

* * * * *